US006016353A

United States Patent [19]

Gunness

[11] Patent Number: 6,016,353

[45] Date of Patent: Jan. 18, 2000

[54] LARGE SCALE SOUND REPRODUCTION SYSTEM HAVING CROSS-CABINET HORIZONTAL ARRAY OF HORN ELEMENTS

[75] Inventor: David W. Gunness, Sutton, Mass.

[73] Assignee: Eastern Acoustic Works, Inc., Whitinsville, Mass.

[21] Appl. No.: 08/962,425

[22] Filed: Oct. 31, 1997

Related U.S. Application Data

[63] Continuation-in-part of application No. 08/921,185, Aug. 29, 1997.

[51] Int. Cl.[7] ..... H04R 1/02; H04R 1/20

[52] U.S. Cl. ..... 381/342; 381/340; 381/82; 381/351; 181/152; 181/145; 181/199

[58] Field of Search ..... 381/82, 332, 335, 381/336, 339, 340, 342, 351, 182, 386; 181/144, 145, 152, 159, 199, 153

[56] References Cited

U.S. PATENT DOCUMENTS

| | | | |
|---|---|---|---|
| 4,174,019 | 11/1979 | Kramer . | |
| 4,308,932 | 1/1982 | Keele, Jr. . | |
| 4,369,857 | 1/1983 | Frazer et al. . | |
| 4,390,078 | 6/1983 | Howze et al. . | |
| 4,503,930 | 3/1985 | McDowell . | |
| 4,805,730 | 2/1989 | O'Neill et al. | 181/148 |
| 4,969,196 | 11/1990 | Nakamura . | |
| 4,982,436 | 1/1991 | Cowan . | |
| 5,000,286 | 3/1991 | Crawford et al. | 181/145 |
| 5,020,630 | 6/1991 | Gunness | 181/192 |
| 5,109,419 | 4/1992 | Griesinger . | |

*Primary Examiner*—Curtis A. Kuntz
*Assistant Examiner*—Rexford N. Barnie
*Attorney, Agent, or Firm*—Haynes and Boone, L.L.P.

[57] ABSTRACT

A loudspeaker system having a cross-cabinet horizontal array of loudspeakers for collectively generating a common acoustical wavefront when respective drivers associated with each of the loudspeakers of the array are similarly driven. The loudspeakers are secured to each other such that adjoining horn side walls for adjacent ones of the loudspeakers are substantially parallel to each other and are relatively deep in relationship to the total length of the loudspeakers, i.e., the length of the sidewalls is about 80% of the depth of the entire loudspeaker. Each horn is angled about 30 degrees off a central axis thereof to provide 30 degrees coverage in the horizontal plane and includes a first, essentially untapered, section which provides the aforementioned coverage in the horizontal plane and a second section having a taper of about 30% to prevent diffraction of the wavefront at the edges of the horn. To mount the loudspeakers to each other in a space efficient manner, each loudspeaker has a generally trapezoidal cross-section sized such that the drivers of the cross-cabinet horizontal array may be closely packed together such that only the walls of the cabinets separate adjacent drivers of the array.

35 Claims, 3 Drawing Sheets

30
40b
62b
64b
40c 40a
40d
40
66b
88b
38b
38c
38d
38a
38
36b
36c
56b
36
58b
36a
36d
60b
2b
34b
34c
34a
46b
48b
2a
50b
2a
52b
34
54b
2b
34d
42b
32a
32
32d
44b
32b
32c

LARGE SCALE SOUND REPRODUCTION SYSTEM HAVING CROSS-CABINET HORIZONTAL ARRAY OF HORN ELEMENTS

CROSS-REFERENCE TO RELATED APPLICATION

This application is a Continuation-in-Part of U.S. patent application Ser. No. 08/921,185 filed on Aug. 29, 1997 entitled "Down-Fill Speaker for Large Scale Sound Reproduction System" and hereby incorporated by reference as if reproduced in its entirety.

TECHNICAL FIELD

The invention relates generally to large scale sound reproduction systems and, more particularly, to a large scale sound reproduction system which includes a cross-cabinet horizontal array of loudspeakers configured to provide generally equal audible sound levels along a horizontal plane.

BACKGROUND OF THE INVENTION

Sound is a physical disturbance in the medium through which it propagates. For example, in air, sound consists of localized variations in pressure above and below normal atmospheric pressure. Accordingly, the vast majority of sound reproduction systems are comprised of electromagnetic transducers in which an electrical signal is transformed into a mechanical vibration which, in turn, is transformed into an acoustic signal. Sound reproduction systems typically include separate loudspeakers, each generating sound within a selected frequency range. For lower frequencies, i.e., frequencies below 300 Hz., loudspeakers are typically comprised of a diaphragm, most commonly, a relatively large cone, a support system in which the cone or other diaphragm is mounted and a driver which vibrates the cone in a desired fashion to produce sound waves. For higher frequencies, i.e., frequencies above 300 Hz., horn loudspeakers, which are characterized by a smaller cone or other type of driver and speaker walls, positioned forward of the cone, which follow a selected pattern are more common.

While sound reproduction systems have been the subject of numerous innovations over the years, pattern control of sound projection within a particular listening area has remained a problem. Effective pattern control is particularly problematic when the sound reproduction system is installed in a stadium or other large structure. While it would be very desirable to provide even sound levels throughout the stadium, various considerations has made such a goal quite difficult. One problem is the dramatic variation between the distance separating the closest and furthermost listeners from the stage. Specifically, while the closest listener may be just a few meters from the stage, the furthermost listener may be as far as 300 meters away. Thus, sound reproduction systems suitable for use in stadiums and other large venues must be capable of throwing sound considerable distances. As sound levels for high frequency sounds tend to drop off dramatically over distance, in order for high frequency sounds to travel these distances, the initial sound levels produced by the sound reproduction system must be quite high. For this reason, many sound reproduction systems capable of generating desired audible sound levels at the furthermost reaches of the stadium inadvertently produce sound far in excess of the desired audible sound levels close to the stage.

A common sound reproduction system used in stadiums and other large venues is generally referred to as a cluster system. Cluster systems are generally characterized by high efficiency, middle and high frequency range speakers having sharp vertical and horizontal directivity and high-power low frequency range speakers. In a cluster system, speakers are concentrated in one or two locations within the stadium or other large venue. While the location of a cluster system within a stadium or other large venue will vary depending on the particular uses contemplated therefor, in order for the cluster system to throw sound the requisite distances, cluster systems are typically elevated on the order of about 20 to 30 feet above their surroundings.

A variety of problems are caused by the design of cluster systems. While low frequency range sounds are generally omni-directional and can propagate, away from the cluster, in all directions, high frequency range sounds are highly directionalized and tend to propagate away from the cluster system in defined "beams" of sound. As a result, therefore, sound levels for high frequency range sounds tend to drop off dramatically outside the beam. Other problems are caused by the cluster system's use of multiple mid and/or high frequency range loudspeakers. For both of these frequency ranges, cluster systems typically include a horizontal array of loudspeakers. Typically each loudspeaker is directionalized to provide acoustical coverage for a selected portion along the horizontal plane. However, the coverage areas of adjacent loudspeakers often overlap, thereby causing a variety of interference problems. Overlap of coverage areas is of particular concern when the loudspeakers are placed in proximity to each other. Thus, the design of a compact, space-efficient array of mid or high frequency loudspeakers which provides uniform coverage in the horizontal plane remains problematic.

SUMMARY OF THE INVENTION

The present invention is of a multi-horn type loudspeaker system which produces generally even sound levels along a horizontal plane by collectively generating a generally continuous arc-shaped acoustic wavefront using plural horns arranged in a space-efficient, cross-cabinet horizontal array.

In one embodiment, the loudspeaker system includes first and second loudspeakers, each having a horn which includes first and second walls. By positioning the horns in a common, generally horizontal, plane and shaping the horns such that the second wall of the first horn and the first wall of the second horn are substantially parallel to each other, the collective wavefront produced when identically driving each of the loudspeakers is generally arc-shaped. Preferably, the second side wall of the first horn is joined to the first side wall of the second horn along their entire length. By angling each horn about 30 degrees off a central axis thereof, each horn provides 30 degrees coverage in the horizontal plane. Each horn includes a first, essentially untapered, section which provides the aforementioned coverage in the horizontal plane and a second section having a taper of about 30% to prevent diffraction of the wavefront at the edges of the horn. In selected aspects thereof, the first and second loudspeakers are supportably mounted within respective cabinets, each having an open front side, a walled rear side, adjoining sidewalls and substantially the same general trapezoidal cross-section.

In another embodiment, the present invention is of a loudspeaker system configurable to provide various coverages in a horizontal plane. The system includes a plurality of loudspeakers arranged in a common horizontal plane and secured to each other such that adjoining horn side walls for adjacent ones of the loudspeakers are substantially parallel to each other. Preferably, each of the loudspeakers include an open front side generally positioned along a first curved line in the horizontal plane and a walled rear side generally positioned along a second curved line in the horizontal plane. In one aspect thereof, each loudspeaker provides 30 degrees of coverage in the horizontal plane. Accordingly, coverage provided by the loudspeaker system may be varied based upon the number of loudspeakers incorporated therein. In another aspect thereof, to facilitate mounting of the loudspeakers to each other such that front and rear sides are respectively positioned along the first and second curved lines, each loudspeaker is supportably mounted in a corresponding cabinet having a walled rear side having a first length, an open front side having a second length and a generally trapezoidal cross-section along a horizontal axis thereof.

In yet another embodiment, the present invention is of a loudspeaker cluster which includes a vertical stack of loudspeaker modules for generating audible sound in respective frequency ranges. Each of the loudspeaker modules is comprised of at least two cabinets in which a loudspeaker is supportably mounted. For at least one of the loudspeaker modules, each one of the cabinets has a side wall which is attached to a side wall of an adjacent cabinet in a substantially parallel relationship, thereby forming a generally horizontal, cross-cabinet array of loudspeakers. In one aspect thereof, the loudspeaker module includes multiple horizontal, cross-cabinet arrays of loudspeakers formed by supportably mounting similarly configured vertical arrays of loudspeakers in each one of the cabinets. In this aspect, the side walls of the cabinets define the side walls for each of the loudspeakers supportably mounted thereby and a separator defines a top wall for one loudspeaker in the vertical array and a bottom wall for a next loudspeaker in the vertical array. In other aspects thereof, others of the loudspeaker modules may similarly include one or more generally horizontal, cross-cabinet arrays of loudspeakers.

DESCRIPTION OF A PREFERRED EMBODIMENT

Figure 1:
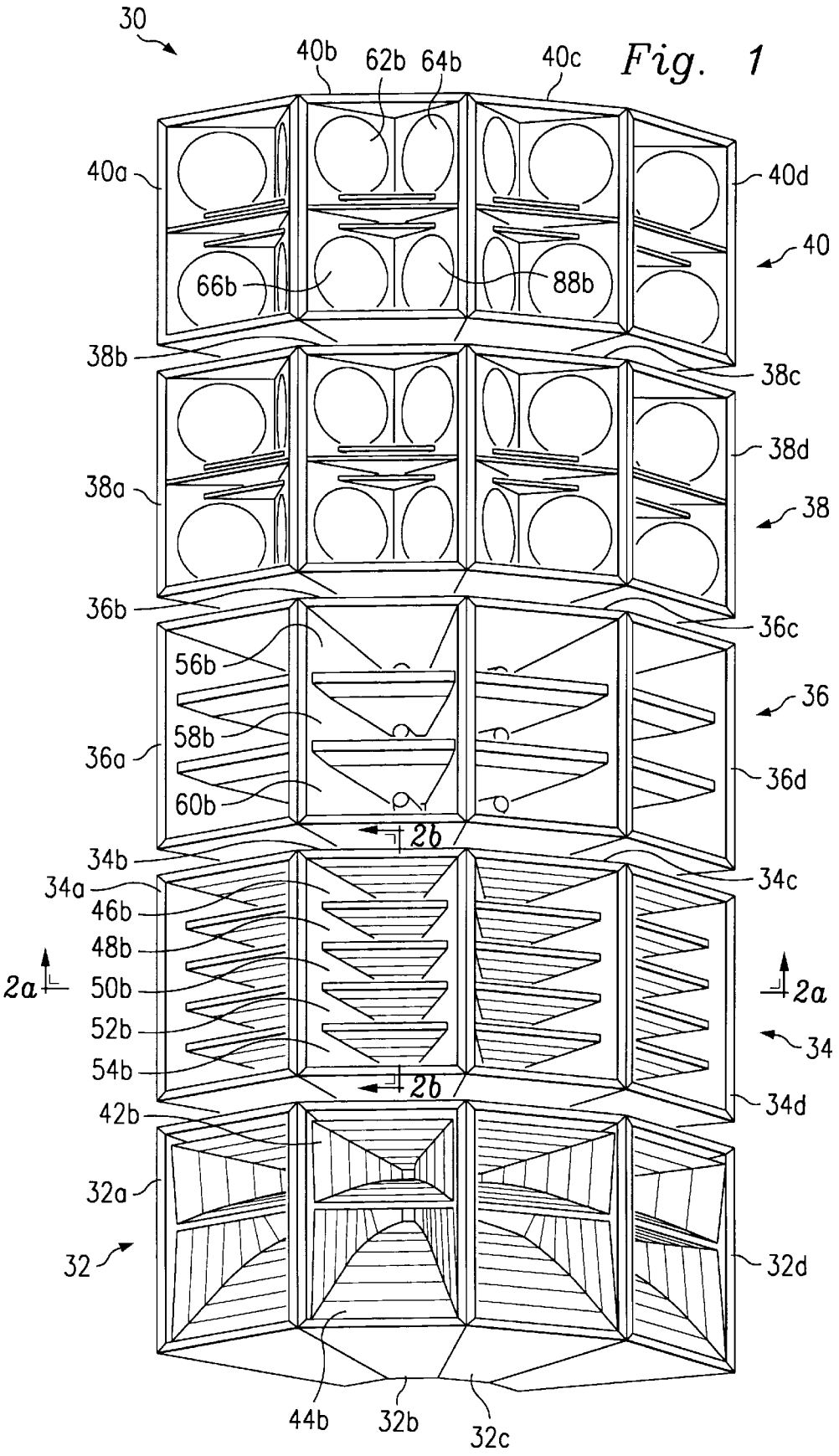
FIG. 1 is a front view of a speaker cluster which includes a cross-cabinet horizontal array of loudspeakers constructed in accordance with the teachings of the present invention.

Turning now to the drawings, in FIG. 1, reference numeral 30 designates a loudspeaker cluster system which forms part of a large scale sound reproduction system. By the term "large scale" sound reproduction system, it is intended to refer to sound reproduction systems suitable for use in a stadium or other large venue. For example, those sound reproduction systems capable of propagating appreciable sound levels, i.e. sound levels on the order of about 75–100 DB at a distance of about 300 feet would be considered to be a large scale sound reproduction system. Of course, the foregoing is but one example of performance characteristics of a large scale sound reproduction system. It should be clearly understood, however, that the invention would be suitable for use in other sound reproduction systems as well.

The loudspeaker cluster 30 is comprised of a down-fill loudspeaker module 32, a high-frequency range loudspeaker module 34, a mid-frequency range loudspeaker module 36 and first and second low-frequency range loudspeaker modules 38 and 40, stacked on top of each other in a generally vertical orientation. Further details as to the configuration and operation of the down-fill loudspeaker module 32 are set forth in my co-pending U.S. patent application Ser. No. 08/921,185, filed Aug. 29, 1997 (Atty. Docket No. 23422.4), entitled "Down-Fill Speaker for Large Scale Sound Reproduction System."

Figure 2A:
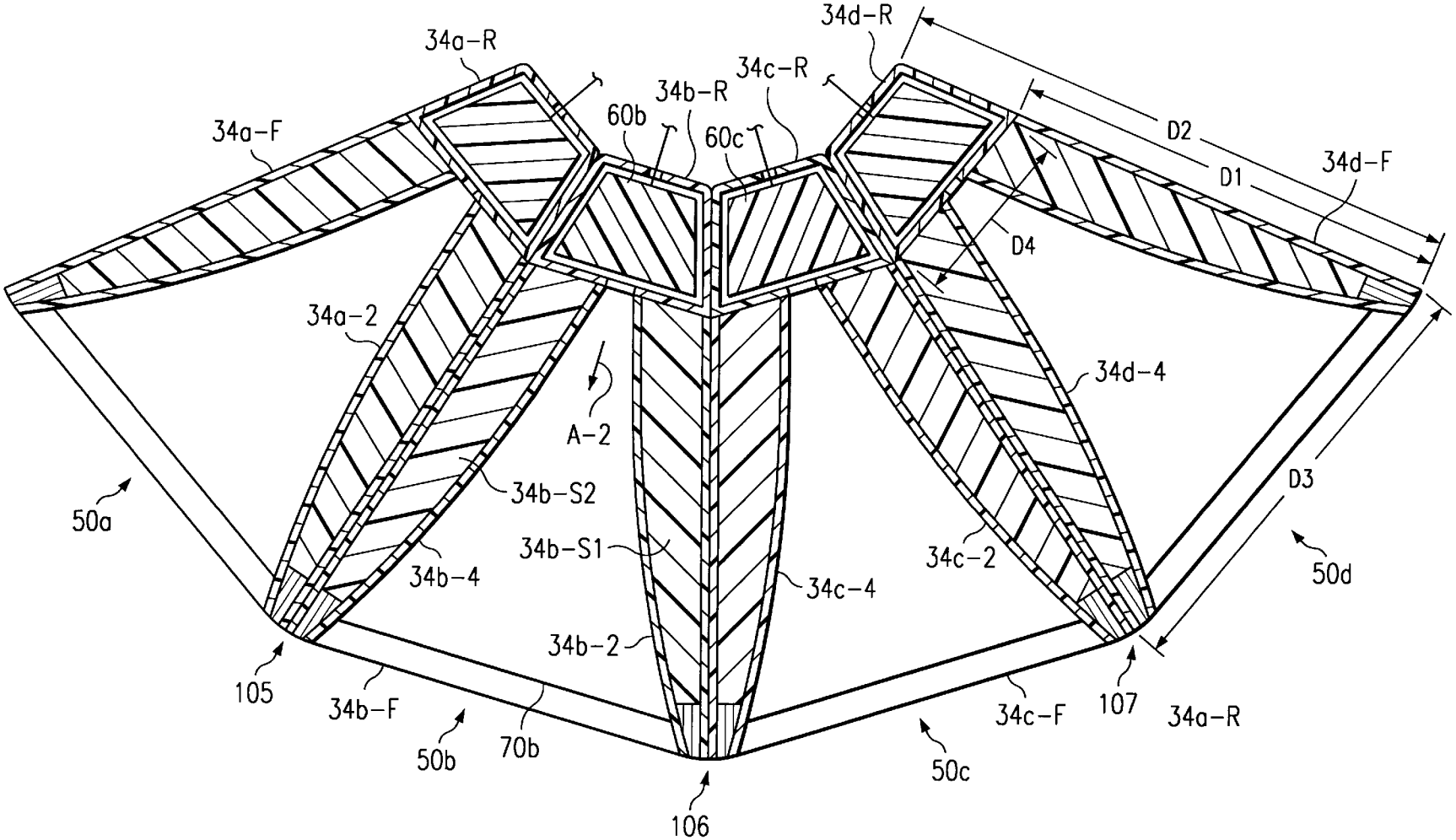
FIG. 2*a* is a cross-sectional view taken across lines 2*a*—2*a* of FIG. 1 to illustrate a horizontal axis of the cross-cabinet horizontal array of loudspeakers of FIG. 1.

The loudspeaker cluster 30 is supportably mounted, for example, by a platform, cables or other support structure (not shown) generally parallel to, and approximately 20–30 feet above, the ground or other listening area. Each loudspeaker module 32, 34, 36, 38 and 40 is comprised of first, second, third and fourth loudspeaker cabinets 32*a* through 32*d*, 34*a* through 34*d*, 36*a* through 36*d*, 38*a* through 38*d* and 40*a* through 40*d*, each identically configured to each other and fixedly mounted to each other along a generally curved line to form the corresponding loudspeaker module 32, 34, 36, 38 or 40. For example, FIG. 2*a* shows the generally curved line for the loudspeaker module 34 to be comprised of rear sides of the loudspeaker cabinets 34*a* through 34*d*. As will be more fully described below, frequencies above 300 Hz are directional in nature and, accordingly, the loudspeakers supportably mounted by each of the cabinets 32*a* through 32*d* of the down-fill loudspeaker module 32, each of the cabinets 34*a* through 34*d* of the high-frequency range loudspeaker module 34 and each of the cabinets 36*a* through 36*d* of the mid-frequency range loudspeaker module 36, respectively, have throats (not shown in FIG. 1) formed to have a throat angle, in the horizontal axis, of about 30 degrees, thereby providing 30 degrees of coverage along a horizontal plane of the stadium or other large venue. Thusly, for mid and high frequency sound, the loudspeaker cluster 30 provides coverage of 120 degrees in the horizontal plane. The loudspeakers supportably mounted by the cabinets 38*a* through 38*d* of the low frequency range loudspeaker module 38 and the cabinets 40*a* through 40*d* of the lower frequency range loudspeaker module 40, on the other hand, each provide omnidirectional coverage of varying magnitude throughout the stadium or other large venue.

As may be further seen in FIG. 1, each cabinet 32*a* through 32*d*, 34*a* through 34*d*, 36*a* through 36*d*, 38*a* through 38*d* and 40*a* through 40*d* supportably mounts plural loudspeakers. For example, for the loudspeaker cluster 30 illustrated in FIG. 1, each cabinet 32*a* through 32*d* of the down-fill loudspeaker module 32, for example, the cabinet 32*b*, supportably mounts a first loudspeaker 42*b* and a second loudspeaker 44*b* positioned below the first loudspeaker 42*b*. Each cabinet 34*a* through 34*d*, for example, the cabinet 34*b*, of the high frequency range loudspeaker module 34 supportably mounts first, second, third, fourth and fifth loudspeakers 46*b*, 48*b*, 50*b*, 52*b* and 54*b* arranged in a vertical array. Each cabinet 36*a* through 36*d*, for example, the cabinet 36*b*, of the mid-frequency range loudspeaker module 36 supportably mounts first, second and third loudspeakers 56*b*, 58*b* and 60*b* arranged in a vertical array. Finally, each cabinet 38*a* through 38*d* and 40*a* through 40*d* of the first and second low-frequency range loudspeaker modules, for example, the cabinet 40*b*, supportably mount first, second, third and fourth loudspeakers 62*b*, 64*b*, 66*b* and 68*b*.

Figure 2B:
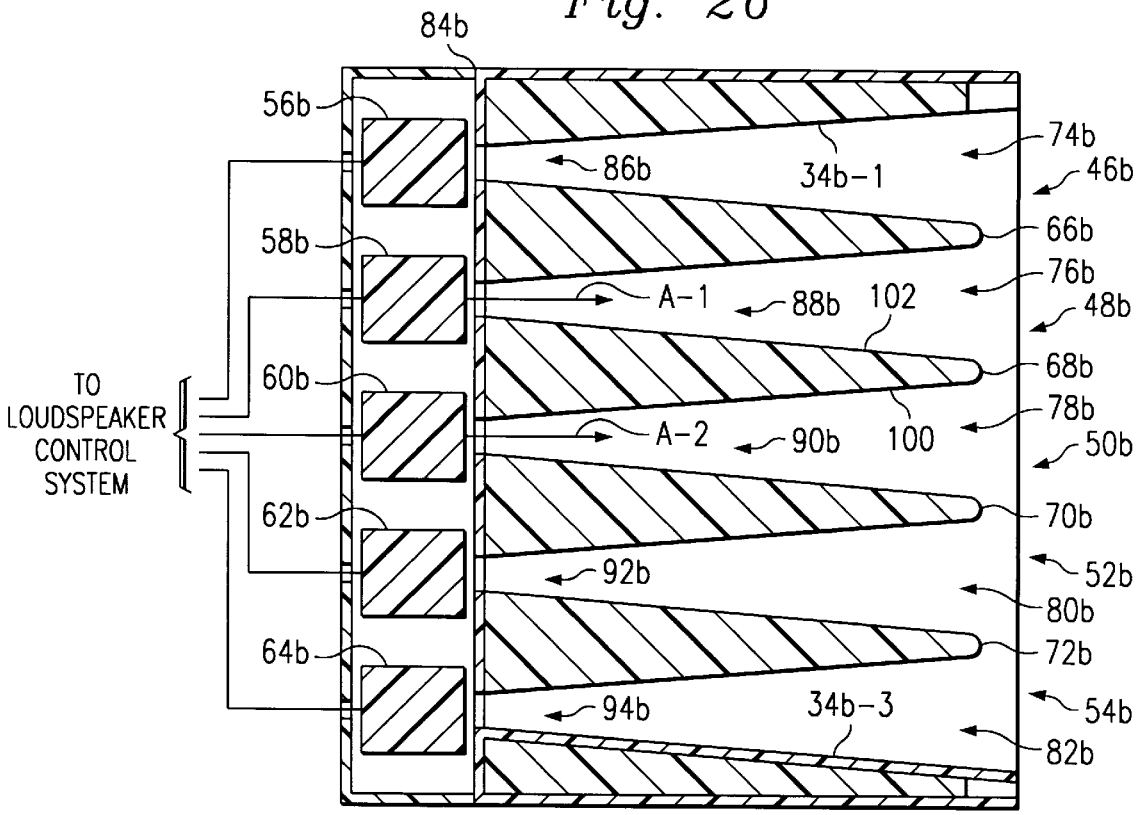
FIG. 2*b* is a cross-sectional view taken across lines 2*b*—2*b* of FIG. 1 to illustrate a vertical axis of the cross-cabinet horizontal array of loudspeakers of FIG. 1.

Turning next to FIGS. 2*a* and 2*b*, the high frequency range loudspeaker module 34 which incorporates plural cross-cabinet arrays of horizontal loudspeakers and is constructed in accordance with the teachings of the present invention will now be described in greater detail. The high frequency range loudspeaker module 34 is comprised of first, second, third and fourth cabinets 34*a*, 34*b*, 34*c* and 34*d*, each of which is identically configured to the others. Furthermore, as each cabinet 34*a* through 34*d* includes a vertical array comprised of first, second, third, fourth and fifth loudspeakers, for example, the vertical array comprised of first, second, third, fourth and fifth loudspeakers 46*b*, 48*b*, 50*b*, 52*b* and 54*b* of the second cabinet 34*b* shown in FIG. 2*b*, the high frequency range loudspeaker module 34 includes a total of twenty loudspeakers 46*a* through 46*d*, 48*a* through 48*d*, 50*a* through 50*d*, 52*a* through 52*d* and 54*a* through 54*d*, grouped together in five cross-cabinet horizontal arrays, one of which is shown in FIG. 2*a*.

Prior to further description of the cross-cabinet horizontal array 50*a* through 50*d*, the configuration of a single cabinet, for example, the cabinet 34*b* shall first be described. As each of the cabinets 34*a* through 34*d* are identically configured along both the vertical and horizontal axes, the description of the configuration of the cabinet 34*b* is equally applicable to the cabinets 34*a*, 34*c* and 34*d*. As may be best seen in FIG. 2*a*, the high frequency range cabinet 34*b* is characterized by a generally trapezoidal cross-section along a horizontal axis thereof and, as best seen in FIG. 2*b*, a generally rectangular cross-section along a vertical axis thereof. The cabinet 32*b* may also be divided into a rear portion 32*b*-R in which drivers 56*b*, 58*b*, 60*b*, 62*b* and 64*b*, each corresponding to one of the loudspeakers 46*b*, 48*b*, 50*b*, 52*b* and 54*b*, are positioned and a front portion 32*b*-F in which the walls 34*b*-1, 34*b*-2, 34*b*-3, 34*b*-4 and parabolic separators 66, 68, 70 and 72 which define the horns 74, 76, 78, 80 and 82 are positioned. It should be clearly understood, however, that the drivers 56*b*, 58*b*, 60*b*, 62*b* and 64*b* are schematically illustrated in FIGS. 2*a*–*b* and are, therefore, shown as having solid cross-sections when, in fact, the drivers 56*b*, 58*b*, 60*b*, 62*b* and 64*b*, if fully illustrated, would likely have cross-sections different from that illustrated herein.

The front and rear portions 32*b*-F and 32*b*-R of the cabinet 32*b* are separated by an interior wall 84*b*. To acoustically couple the drivers 56*b*, 58*b*, 60*b*, 62*b* and 64*b* to the corresponding ones of the horns 74*b*, 76*b*, 78*b*, 80*b* and 82*b*, throats 86*b*, 88*b*, 90*b*, 92*b* and 94*b* are formed in the interior wall 84*b*. Preferably, the throats 86*b*, 88*b*, 90*b*, 92*b* and 94*b* are formed along the interior wall 84*b* in the general center of the portion of the horn 74*b*, 76*b*, 78*b*, 80*b* and 82*b* in communication therewith. Depending on the desired operational characteristics of the loudspeaker associated therewith, the shape of the throats 86*b* through 94*b* may be variously selected. For example, by varying the length, width and throat angle of selected ones of the throats 86*b*, 88*b*, 90*b*, 92*b* and 94*b*, the acoustical propagation characteristics of the horn 74*b*, 76*b*, 78*b*, 80*b* and 82*b* associated therewith may be selectively modified. Purely by way of example, a generally circular-shaped throat having a diameter of about 2 inches will be a suitable shape for each of the throats 86*b* through 94*b*. Furthermore a throat angle of 30 degrees in the horizontal axis and a throat angle of 15 degrees in the vertical axis will provide suitable acoustical coverage in the horizontal and vertical planes, respectively.

As previously set forth, mounted within each of the cabinets 34*a*, 34*b*, 34*c* and 34*d* is a vertical array of horns, for example, the horns 74*b*, 76*b*, 78*b*, 80*b* and 82*b*, separated by parabolic separators, for example, the parabolic separators 66*b*, 68*b*, 70*b* and 72*b*. Each of the horns 74*b*, 76*b*, 78*b*, 80*b* and 82*b* provide acoustical coverage for a respective segment of the vertical plane. The angle of the side surfaces of the parabolic separators 66*b*, 68*b*, 70*b* and 72*b*, for example the side surfaces 100 and 102 of the parabolic separator 68*b*, relative to the interior wall 84*b* should generally match the angle of the corresponding throat along the vertical axis. Thus, in the embodiment of the invention disclosed herein, the side surface 102 should be angled approximately 15 degrees below axis A-1 while the side surface 100 should be angled approximately 15 degrees above axis A-2. As their name suggests, the parabolic separators 66*b*, 68*b*, 70*b* and 72*b* are characterized by an increasingly higher slope as they extend away from a starting point. Accordingly, the parabolic separators 66*b*, 68*b*, 70*b* and 72*b* are gently curved at one end but are generally straight thereafter. By shaping the parabolic separators 66*b*, 68*b*, 70*b* and 72*b* in this manner, smooth transitions are achieved between adjacent horns in the vertical plane While, as disclosed herein, it is contemplated that each of the parabolic separators 66*b*, 68*b*, 70*b* and 72*b* are similarly sized in the lengthwise dimension, it is contemplated that, in an alternate embodiment of the invention, the lengths of the parabolic separators 66*b*, 68*b*, 70*b* and 72*b* may be varied, for example, by staggering the parabolic separators so that the uppermost one is the longest while the lowermost one is the shortest.

Returning now to FIG. 2*a*, certain aspects of the shape of the cabinet 34*b* which enable it to function as part of a horizontal cross-cabinet array of loudspeakers shall now be described in greater detail. As previously stated, the cabinet 34*b* is generally trapezoidal in shape in the horizontal plane. The generally trapezoidal shape is defined by a first pair of sides—an open front side 34*b*-F and a walled rear side 34*b*-R—which are generally parallel to each other and a second pair of non-parallel sides—first and second side walls 34*b*-S1 and 34*b*-S2. It has been discovered that, by sizing the front side 34*b*-F to be about three times the length of the rear side 34*b*-R, the cabinet 34*b* is particularly well suited to form a portion of a space-efficient cross-cabinet array of loudspeakers.

Continuing to refer to FIG. 2*a*, certain other relational characteristics of the driver 60*b*, the interior wall 84*b*, the throat 90*b* and the interior side surfaces of the side walls 34*b*-2 and 34*b*-4 shall now be described in greater detail. Axis A-2 is generally orthogonal to the interior sidewall 84*b*. The throat 90*b* is angled as it extends through the interior wall 84*b* to acoustically couple the driver 60*b* and the horn 78*b*. This angle is commonly referred to as a beam angle for the loudspeaker in that, for high frequency sound generated thereby, the beam angle controls coverage for acoustical signals propagating therefrom. As previously stated, a suitable beam angle for the throat 90*b* along the horizontal axis is 30 degrees. Preferably, the side surfaces 34*b*-2 and 34*b*-4 are closely matched to the beam angle. Accordingly, the side surfaces 34*b*-2 and 34*b*-4 are preferably angled 30 degrees on respective sides relative to the axis A-2.

The angle of the throat 90*b* relative to the interior wall 84*b* is about 30 degrees. Accordingly the coverage of the horn 50*b* defined by a bottom side surface of the parabolic separator 68*b*, an interior side surface of the side wall 34*b*-2, a top side surface of the parabolic separator 70*b* and an interior side surface of the side wall 34*b*-4 in the horizontal plane is about 30 degrees. A first portion of the sidewalls 34*b*-2 and 34*b*-4 are substantially straight along their length and closely match, therefore, the beam angle for the horn 74*b*. Preferably, the first portion of the sidewalls 34*b*-2 and 34*b*-4 which are formed to be substantially straight with each other should be at least ⅔ of the entire length of the respective sidewalls 34*b*-2 and 34*b*-4. The remainder of the sidewalls 34*b*-2 and 34*b*-4 are slightly tapered to prevent edges of the horn 70*b* from acting like acoustic point sources. For example, a taper of about 30 degrees along the second portion of the sidewalls 34*b*-2 and 34*b*-4 would be suitable for this purpose. Preferably, the tapers of the sidewalls are shaped such that the wall separating adjacent horns is in the shape of a parabolic separator.

As previously set forth, in order to minimize interference of acoustic signals respectively generated by adjacent horns which collectively comprises a cross-cabinet horizontal array of loudspeakers such that the respective acoustic signals produced when the drivers associated with the respective horns are identically driven may be viewed as a common acoustical wavefront collectively generated by the cross-cabinet horizontal array of loudspeakers, certain relationships between various ones of the horns should exist. As may be seen in FIG. 2*a*, adjacent ones of the horns share a common wall. For example, the horns 50*a* and 50*b* share common wall 105, the horns 50*b* and 50*c* share common wall 106 and the horns 50*c* and 50*d* share common wall 107. Each common wall 105, 106 and 107 is preferably formed in the shape of a parabolic separator, includes a portion of each of the adjacent pair of cabinets and has first and second side surfaces, each of which partially defines one of the adjacent horns. For example, the common wall 105 includes first and second side surfaces 34*a*-2 and 34*b*-4 which partially define the horns 50*a* and 50*b*, respectively. Similarly, the common wall 106 includes side surfaces 34*b*-2 and 34*c*-4 which partially define the horns 50*b* and 50*c*, respectively. Finally, the common wall 107 includes side surfaces 34*c*-2 and 34*d*-4 which partially define the horns 50*c* and 50*d*, respectively. In order for the acoustic signals respectively generated by the drivers 60*a*, 60*b*, 60*c* and 60*d* to form a common wavefront, the side surfaces 34*a*-2 and 34*b*-4, 34*b*-2 and 34*c*-4, 34*c*-2 and 34*d*-4 for each common wall 105, 106, 107, must be substantially parallel to each other along a first portion thereof. Such a result may be achieved by shaping the common walls 105, 106 and 107 as parabolic separators where, for a first portion comprising about ⅔ of the common walls 105, 106, 107, the side surfaces 34*a*-2 and 34*b*-4, 34*b*-2 and 34*c*-4, 34*c*-5 and 34*d*-4 thereof are substantially parallel to each other. To further enhance the common acoustical wavefront generated by the cross-cabinet horizontal array of loudspeakers, it is preferred that each of the horns 50*a* through 50*d* of the cross-cabinet array be "deep" relative to the cabinet in which it reside. For example, a horn having a length D1 which is approximately 80% of the length D2 of the cabinet in which it resides may be considered to be a "deep" horn.

It has been further discovered that other relationships further enhance the present invention of a space efficient, cross-cabinet horizontal array of loudspeakers. Specifically, by forming each cabinet such that it has a generally trapezoidal cross-section along the horizontal axis thereof, the cabinets can be easily mounted to each other in a space efficient manner which avoids gapping between adjacent ones of the loudspeakers. It is further preferred that each of the cabinets be sized such that the width D3 of the front side, i.e., the distance separating a pair of common walls is approximately twice the width D4 of the interior wall 84 which separates the front and rear portions of the cabinet. By dimensioning the cabinets in this manner, it has been discovered that the drivers will predominately fill the rear portions of the cabinets, thereby closely positioning the drivers of the various horns included in a cross-cabinet horizontal array to each other such that, in most cases, only the walls which define the cabinets separate a driver of the cross-cabinet horizontal array from an adjacent driver of the array, a highly space-efficient packing of the drivers of a cross-cabinet horizontal array which has, heretofore, not been achieved.

Although illustrative embodiments of the invention have been shown and described, other modifications, changes, and substitutions are intended in the foregoing disclosure. Accordingly, it is appropriate that the appended claims be construed broadly and in a manner consistent with the scope of the invention.

What is claimed is:

1. A loudspeaker system, comprising:

a first loudspeaker having a horn which includes first and second side walls, each of said first and second side walls having an interior side surface which partially defines said horn;

a second loudspeaker having a horn which includes first and second side walls, each of said first and second side walls having an interior side surface which partially defines said horn;

said horn of said first loudspeaker and said horn of said second loudspeaker being positioned in a generally horizontal plane;

said second side wall of said horn of said first loudspeaker engaging said first side wall of said horn of said second loudspeaker such that said interior side surface of said second side wall of said horn of said first loudspeaker is substantially parallel to said interior side surface of said first side wall of said horn of said second loudspeaker.

2. A loudspeaker system according to claim 1, wherein said second side wall of said horn of said first loudspeaker and said first side wall of said horn of said second loudspeaker are joined together along their length.

3. A loudspeaker system according to claim 2, wherein the angle of each of said horns in said generally horizontal plane is about 30 degrees.

4. A loudspeaker system according to claim 2, wherein each of said horns further comprises a first, essentially untapered, section along which said interior side surface of said second side wall of said horn of said first loudspeaker and said interior side surface of said first side wall of said horn of said second loudspeaker are substantially straight and a second section along which said interior side surface of said second side wall of said horn of said first loudspeaker and said interior side surface of said first side wall of said horn of said second loudspeaker have a taper of about 30%.

5. A loudspeaker system according to claim 4, wherein each one of said first and second loudspeakers further comprise a driver acoustically coupled to said horn.

6. A loudspeaker system according to claim 5, wherein each one of said first and second loudspeakers further comprise first and second portions separated by an interior wall, said horn residing in said first portion and said driver residing in said second portion.

7. A loudspeaker system according to claim 6, wherein the ratio of the length of said first portion to the length of said second portion is about 4:1.

8. A loudspeaker system according to claim 1 ,and further comprising:

a first cabinet in which said first loudspeaker is supportably mounted;

a second cabinet in which said second loudspeaker is supportably mounted;

said first cabinet having a first, generally trapezoidal, cross-section along a horizontal axis thereof and said second cabinet have a second, generally trapezoidal, cross-section along a horizontal axis thereof;

said first and second generally trapezoidal cross-sections being substantially the same.

9. A loudspeaker system according to claim 8 wherein:

said first cabinet further comprises an open front side, a walled rear side and said first and second side walls of said first loudspeaker; and said second cabinet further comprises an open front side, a walled rear side and said first and second side walls of said second loudspeaker; and wherein said second side wall of said first cabinet is joined to said first side wall of said second cabinet along their entire length.

10. A loudspeaker system according to claim 8 wherein each of said horns further comprises a first, essentially untapered, section along which said interior side surface of said second side wall of said horn of said first loudspeaker and said interior side surface of said first side wall of said horn of said second loudspeaker are substantially straight and a second section along which said interior side surface of said second side wall of said horn of said first loudspeaker and said interior side surface of said first side wall of said horn of said second loudspeaker have a taper of about 30%.

11. A loudspeaker system according to claim 10, wherein:

each one of said first and second loudspeakers include first and second portions separated by an interior wall, said horn residing in said first portion and said driver residing in said second portion; and the ratio of the length of said first portion to the length of said second portion is about 4:1.

12. A loudspeaker system, comprising:

a plurality of loudspeakers arranged in a generally horizontal plane, each one of said plurality of loudspeakers having a horn which includes first and second side walls and is partially defined by an interior side surface of said first side wall and an interior side surface of said second side wall;

said second side wall of a first one of said plurality of loudspeakers fixedly secured to said first side wall of an adjacent one of said plurality of loudspeakers such that said interior side surface of said second side wall of said horn of said first one of said plurality of loudspeakers is substantially parallel to said interior side surface of said first side wall of said horn of said adjacent one of said plurality of loudspeakers.

13. A loudspeaker system according to claim 12, wherein each one of said plurality of loudspeakers further comprises an open front side and wherein said front side of each one of said plurality of loudspeakers is generally positioned along a first curved line in said generally horizontal plane.

14. A loudspeaker system according to claim 13, wherein each one of said plurality of loudspeakers further comprises a walled rear side and wherein said rear side of each one of said plurality of loudspeakers is generally positioned along a second curved line in said generally horizontal plane.

15. A loudspeaker system according to claim 14, wherein each one of said plurality of loudspeakers provides 30 degrees coverage in said generally horizontal plane.

16. A loudspeaker system according to claim 14 wherein:

said second side wall of said horn of each one of said plurality of loudspeakers has a first length;

said first side wall of said horn of said adjacent one of said plurality of loudspeakers has a second length generally equal to said first length; and said second side wall of said horn of said first loudspeaker is joined to said first side wall of said horn of said adjacent one of said loudspeaker along said first and second lengths, respectively.

17. A loudspeaker system according to claim 16 wherein each one of said loudspeakers is supportably mounted in a cabinet having a generally trapezoidal cross-section along a horizontal axis thereof.

18. A loudspeaker system according to claim 17 wherein each one of said cabinets has a walled rear side having a first length and an open front side having a second length at least three that of said first length.

19. A loudspeaker system according to claim 18, wherein:

each one of said first and second loudspeakers include first and second portions separated by an interior wall, said horn residing in said first portion and said driver residing in said second portion; and the ratio of the length of said first portion to the length of said second portion is about 4:1.

20. A loudspeaker system according to claim 19, wherein the length of said second portion is substantially the same as the length of said driver residing therein.

21. A loudspeaker system according to claim 20 wherein said horn of each one of said plurality of loudspeakers further comprises a first, essentially untapered, section along which said interior side surface of said second side wall of said horn of said first one of said plurality of loudspeakers and said interior side surface of said first side wall of said horn of said adjacent one of said plurality of loudspeakers are substantially straight and a second section along which said interior side surface of said second side wall of said horn of said first one of said plurality of loudspeakers and said interior side surface of said first side wall of said horn of said adjacent one of said plurality of loudspeakers have a taper of about 30%.

22. A loudspeaker cluster, comprising:

a first loudspeaker module; and a second loudspeaker module vertically stacked on said first loudspeaker module;

said first loudspeaker module comprised of at least two cabinets, each one of said at least two cabinets of said first loudspeaker module being attached to an adjacent one of said at least two cabinets of said first loudspeaker module;

each one of said at least two cabinets of said first loudspeaker module supportably mounting a first loudspeaker;

said first loudspeaker of each one of said at least two cabinets of said first loudspeaker module forming a first, generally horizontal, cross-cabinet loudspeaker array;

each one of said at least two cabinets of said first loudspeaker module having first and second side walls which respectively define first and second side walls for said first loudspeaker supportably mounted thereby;

said second side wall of said first loudspeaker of a first one of said at least two cabinets of said first loudspeaker module being joined to said first side wall of said first loudspeaker of a second, adjacent, one of said at two cabinets;

wherein an interior side surface of said second side wall of said first loudspeaker of said first one of said at least two cabinets of said first loudspeaker module being substantially parallel to an interior side surface of said first side wall of said first loudspeaker of said second, adjacent, one of said at least two cabinets of said first loudspeaker module.

23. A loudspeaker cluster according to claim 22 wherein:

each one of said at least two cabinets of said first loudspeaker module supportably mounts a second loudspeaker;

said first and second loudspeakers of each one of said at least two cabinets of said first loudspeaker module being arranged in a first, generally vertical, loudspeaker array;

said second loudspeaker of each one of said at least two cabinets of said first loudspeaker module forming a second, generally horizontal, cross-cabinet loudspeaker array;

said first and second side walls of each one of said at least two cabinets of said first loudspeaker module further defining first and second side walls for said second loudspeaker supportably mounted thereby;

wherein an interior side surface of said second side wall of said second loudspeaker of said first one of said at least two cabinets of said first loudspeaker module being substantially parallel to an interior side surface of said first side wall of said second loudspeaker of said second, adjacent, one of said at least two cabinets of said first loudspeaker module.

24. A loudspeaker cluster according to claim 23 wherein each one of said at least two cabinets of said first loudspeaker module further comprises a separator which defines a top wall for said first loudspeaker supportably mounted thereby and a bottom wall for said second loudspeaker supportably mounted thereby.

25. A loudspeaker cluster according to claim 24 wherein:

said second loudspeaker module is comprised of at least two cabinets, each one of said at least two cabinets of said second loudspeaker module being attached to an adjacent one of said at least two cabinets of said second loudspeaker module;

each one of said at least two cabinets of said second loudspeaker module supportably mounting a first loudspeaker;

said first loudspeaker of each one of said at least two cabinets of said second loudspeaker module forming a third, generally horizontal, cross-cabinet loudspeaker array;

each one of said at least two cabinets of said second loudspeaker module having first and second side walls which respectively define first and second side walls for said first loudspeaker supportably mounted thereby;

said second side wall of said first loudspeaker of a first one of said at least two cabinets of said second loudspeaker module being joined to said first side wall of said first loudspeaker of a second, adjacent, one of said at two cabinets of said second loudspeaker module;

wherein an interior side surface of said second side wall of said first loudspeaker of said first one of said at least two cabinets of said second loudspeaker module being substantially parallel to an interior side surface of said first side wall of said first loudspeaker of said second, adjacent, one of said at least two cabinets of said second loudspeaker module.

26. A loudspeaker cluster according to claim 25 wherein:

each one of said at least two cabinets of said second loudspeaker module supportably mounts a second loudspeaker;

said first and second loudspeakers of each one of said at least two cabinets of said second loudspeaker module being arranged in a second, generally vertical, loudspeaker array;

said second loudspeaker of each one of said at least two cabinets of said second loudspeaker module forming a fourth, generally horizontal, cross-cabinet loudspeaker array;

said first and second side walls of each one of said at least two cabinets of said second loudspeaker module further defining first and second side walls for said second loudspeaker supportably mounted thereby;

wherein an interior side surface of said second side wall of said second loudspeaker of said first one of said at least two cabinets of said second loudspeaker module being substantially parallel to an interior side surface of said first side wall of said second loudspeaker of said second, adjacent, one of said at least two cabinets of said second loudspeaker module.

27. A loudspeaker cluster according to claim 26 wherein said first loudspeaker module generates sound in a first frequency range and said second loudspeaker module generates sound in a second frequency range.

28. A loudspeaker cluster according to claim 27 wherein each one of said at least two cabinets of said second loudspeaker module further comprises a separator which defines a top wall for said first loudspeaker supportably mounted thereby and a bottom wall for said second loudspeaker supportably mounted thereby.

29. A loudspeaker system according to claim 4 wherein, for each of said horns, the length of said first, essentially untapered, section is at least twice the length of said second, tapered, section.

30. A loudspeaker system according to claim 10 wherein, for each of said horns, the length of said first, essentially untapered, section is at least twice the length of said second, tapered, section.

31. A loudspeaker system according to claim 21 wherein, for each of said horns, the length of said first, essentially untapered, section is at least twice the length of said second, tapered, section.

32. A loudspeaker system, comprising:

a first side wall having an interior side surface;

a second, shared, side wall having first and second interior side surfaces;

a third side wall having an interior side surface;

said interior side surface of said first side wall and said first interior side surface of said second, shared, wall partially defining a first horn of said loudspeaker system;

said second interior side surface of said second, shared, side wall and said interior side surface of said third side wall partially defining a second horn of said loudspeaker system;

said first and second interior side surfaces of said second, shared, wall being substantially parallel to each other.

33. A loudspeaker system according to claim 32 wherein said second, shared, wall is formed in the shape of a parabolic separator.

34. A loudspeaker system according to claim 33 wherein each of said first and second interior side surfaces of said second, common, wall are comprised of first and second portions and wherein said first portion of said first interior side surface of said second, common, side wall is substantially parallel to said first portion of said second interior side surface of said second, common, side wall.

35. A loudspeaker system according to claim 34 wherein the ratio of the length of said first portion of said first interior side surface of said second, common, wall to the length of said first interior side surface of said second, common, wall is about 2:3.

* * * * *